US005421126A

United States Patent [19]

Strege

[11] Patent Number: 5,421,126

[45] Date of Patent: Jun. 6, 1995

[54] SANDER ATTACHMENT FOR ATTACHING TO AN EXISTING FENCE

[76] Inventor: Alan B. Strege, 10047 Venetian Way, Dallas, Tex. 75229

[21] Appl. No.: 169,199

[22] Filed: Dec. 20, 1993

[51] Int. Cl.[6] ..... B24B 21/00

[52] U.S. Cl. ..... 451/296; 451/301; 451/303; 451/355; 451/438

[58] Field of Search ..... 51/135 R, 137, 139, 51/141, 170 EB, 241 G, 215 E

[56] References Cited

U.S. PATENT DOCUMENTS 4,924,633 5/1990 Hock et al. ..... 51/135 R
4,964,241 10/1990 Conklin ..... 51/135 R

*Primary Examiner*—Bruce M. Kisliuk
*Assistant Examiner*—Eileen P. Morgan
*Attorney, Agent, or Firm*—John E. Vandigriff

[57] ABSTRACT

The invention is to a jig that may be either temporarily or permanently mounted for use on a simple, low cost, belt or drum sander. On a belt sander, the jig is placed over the fence on the sander and secured thereto by thumb screws, or may be bolted to the sides of some sanders. The jig is mounted adjacent to a drum sander. The jig is an adjustable guide under which a work piece is placed. When the work piece is sanded to the desired thickness, the attachment is stopped from further downward movement by set screws, and the work piece is not further sanded.

13 Claims, 8 Drawing Sheets

SANDER ATTACHMENT FOR ATTACHING TO AN EXISTING FENCE

FIELD OF THE INVENTION

This invention relates to power sanders, and more particularly to an attachment to belt and drum sanders to permit precision sanding to a desired thickness.

BACKGROUND OF THE INVENTION

Sanders usually consist of a sanding belt traveling on power driven rollers. Some belt sanders have a fence which is attached to the frame of the sander and extends up, above, and across the sanding belt to provide a stop against which the work piece (wood or other material) is placed to prevent it from being moved with the sanding belt. The operator places the work piece on the moving belt and against the fence to sand the work piece. The work piece must be sanded and then measured several times to ensure that the work piece is of the proper thickness.

SUMMARY OF THE INVENTION

The invention is to a jig that may be either temporarily or permanently mounted on a sander. The jig is fastened either to an existing standing fence on the sander or to a device especially designed for attachment thereto. The jig is adjusted to a desired height above the sanding belt or drum by set screws. The jig is an adjustable device under which the work piece to be sanded is placed.

The work piece, which is thicker than the setting of the set screws, holds the jig flexed creating pressure on the work piece until it is sanded to the thickness determined by the adjustment of the set screws, which limit the downward travel of the jig. When the jig is no longer flexed, the work piece is not further sanded.

The jig may be made from metal, plastic, or a composition material. In one embodiment, a roller is used to press downward on the work piece. In another embodiment, the underside of the jig is pressed downward on the work piece. The jig can be adapted equally well for use with either belt or drum sanders.

The jig, when used with a belt sander, is placed over the fence on the sander and secured thereto by thumb screws, or may be bolted to the sides of some sanders. The attachment is an adjustable guide under which the work piece is placed. The guide is adjusted to a desired height above the sanding belt by set screws. The work piece, which is thicker than the setting of the set screws, holds the attachment flexed upward until the work piece is sanded to the thickness set by the set screws. When the work piece is sanded to the desired thickness, the attachment is stopped from further downward movement toward the sanding surface by the set screws, and the work piece is not further sanded.

The technical advance represented by the invention, as well as the objects thereof, will become apparent from the following description of a preferred embodiment of the invention when considered in conjunction with the accompanying drawings, and the novel features set forth in the appended claims.

DESCRIPTION OF A PREFERRED EMBODIMENT

Figure 1:
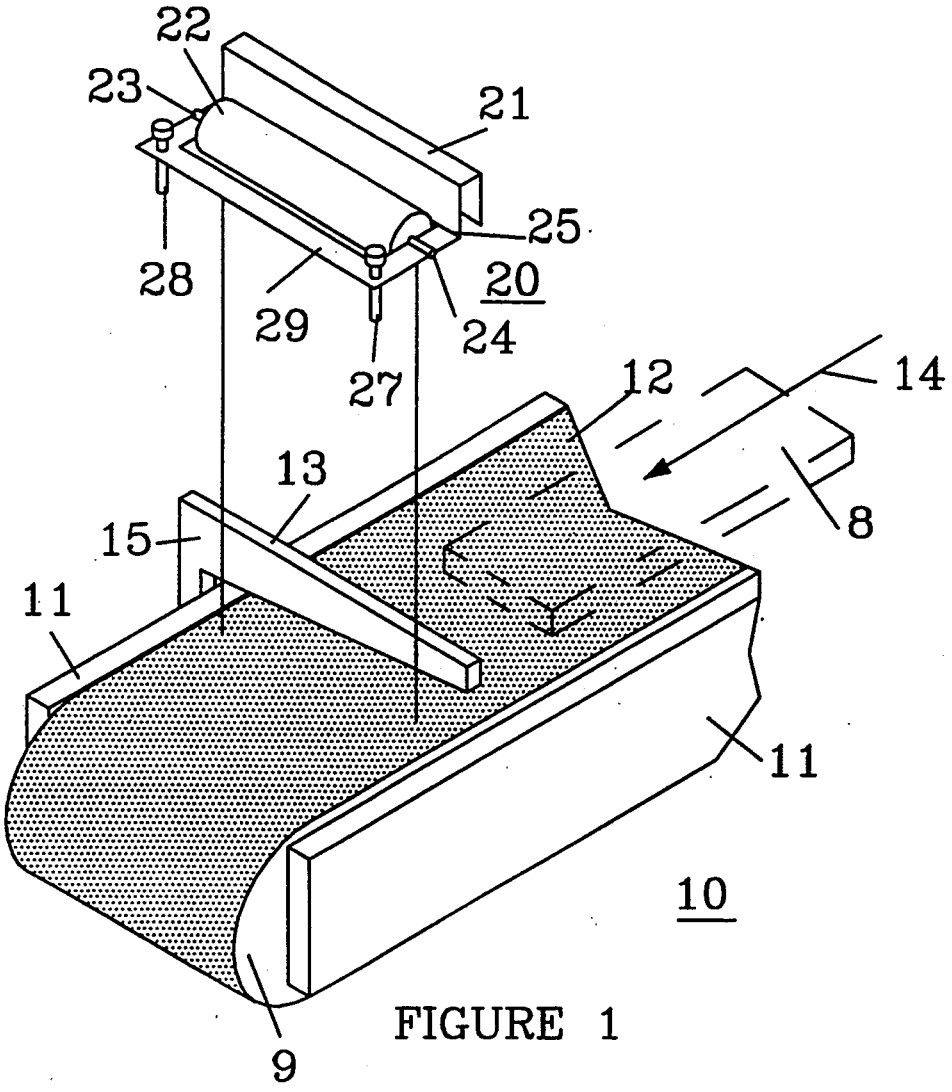
FIG. 1 shows the attachment of the invention positioned above a standard sander.

FIG. 1 illustrates a partial view of a standard belt sander 10, which includes a frame 11, a sanding belt 12 which is mounted on a pair of rollers 9 (only one shown), and a sanding fence 13 mounted by vertical arm 15 to one side of frame 11. When a work piece is to be sanded, it is placed on sanding belt 12, as illustrated at 8. The motion of sanding belt 12, as indicated by arrow 14 pulls work piece 8 against sanding fence 13. This prevents the work piece from being pulled from the hand of the worker.

The invention is illustrated positioned above sander 10. The invention 20 is an apparatus that attaches to the fence 13, and is used to sand small work pieces to a desired thickness.

Jig 20 includes a mounting bracket 21 having a horizontal mounting surface 25, and a leading edge 29. Mounted on horizontal surface 25 is roller 22, attached to surface 25 by shafts 23 and 24. Positioned on leading edge 29 are two adjustment screws 27 and 28.

Figure 2:
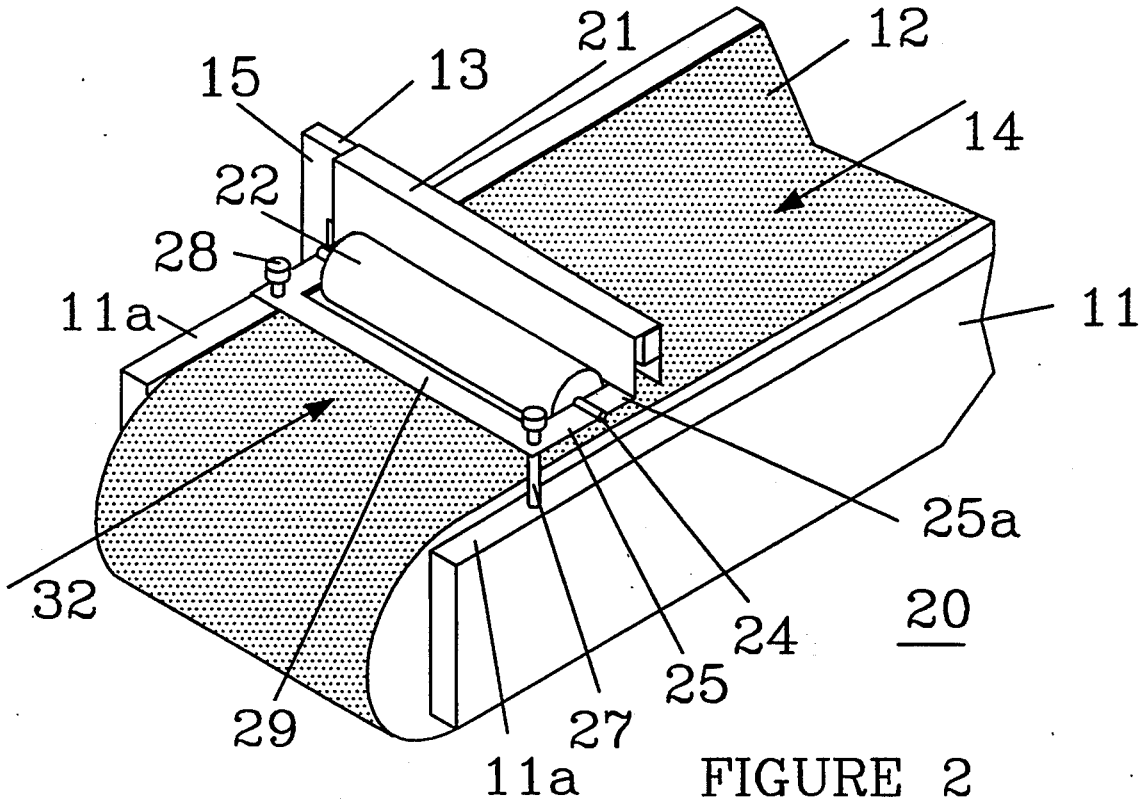
FIG. 2 shows the jig attached to the sander.

FIG. 2 illustrates jig 20 positioned over and mounted on fence 13. Roller 22 is positioned above sanding belt 12 by a distance determined by set screws 27 and 28. Bracket 21 is positioned on fence 13 with surface 25 extending over the top surface 11*a* of frame 11. Set screws 27 and 28 are adjusted against frame 11 to position roller 22 at a desired height above sanding belt 12. Surface 25 is an integral part of bracket 21 and flexes at 25*a* to allow roller 22 to be moved upward when a work piece (not illustrated) is moved under roller 22, between roller 22 and sanding belt 12. The work piece is moved under roller 22 in the direction indicated by arrow 32, flexing roller 22, surface 25 and edge 29 upward. This placement of the work piece is opposite from the direction of sanding when the sander is used without attachment 20.

Figure 3:
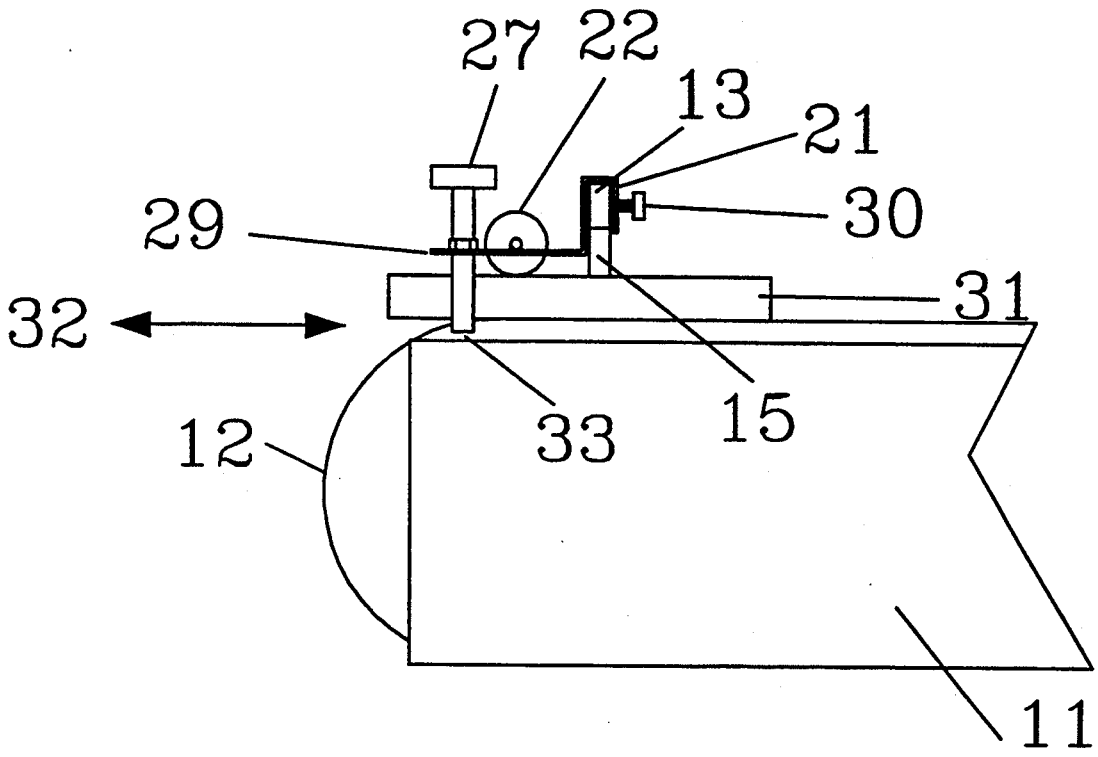
FIG. 3 is a side view of the sander and the jig.

FIG. 3 is a side view of sander 10 with jig 20 mounted on fence 13. Bracket 21 may be attached to 13 with a tight friction fit of bracket 21 on 13, or bracket 21 may be secured to fence 13 by one or more screws 30. Other means of securing fence 13 may be used, for example clamps or bolts.

Work piece 31 is shown under roller 22. The bottom side of work piece 31 is sanded as it is moved back-and-forth along the sanding surface, as indicated by arrow 32. Initially, work piece 31 is thicker than the distance between roller 22 and sanding belt 12. This is indicated by the gap 33 between the end of set screw 27 and the top of frame 11. As work piece is sanded, it becomes thinner and roller 22 is lowered as well as the ends of set screws 27 and 28. When the thickness of work piece 31 is equal to the distance, as set by screws 27 and 28, between roller 22 and sanding belt 12, there will be no sanding action between work piece 31 and sanding belt 12. The sanding is then complete and work piece has been sanded to the desired thickness. During sanding, work piece may 31 be sanded on opposite sides to smooth each side. However, only one side need be sanded to reduce work piece 31 to the desired thickness.

The sanding of work piece 31 is useful in sanding thin strips of wood or other sandable material to a desired thickness. The thickness of the sanded strip is determined by the settings of set screws 27 and 28.

Figure 4:
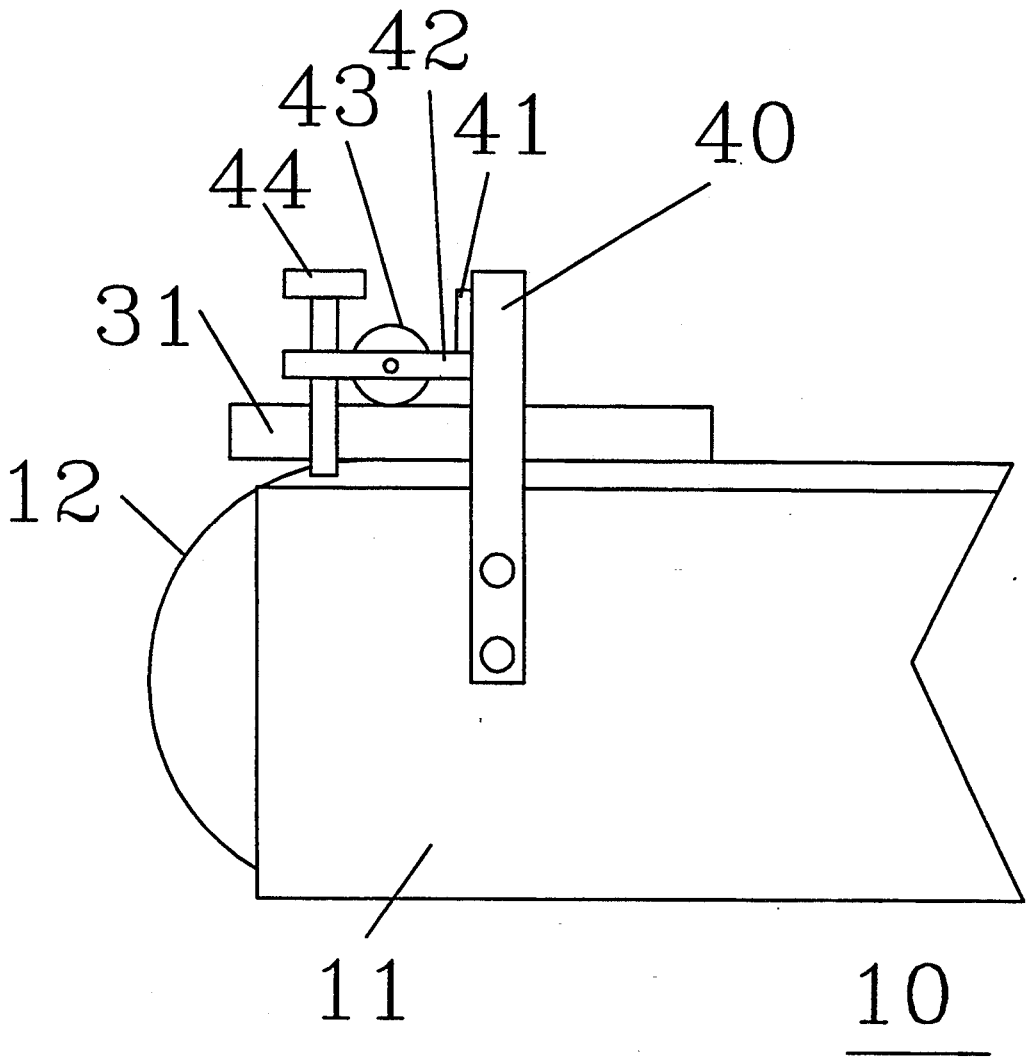
FIG. 4 shows a different attachment of the invention.

FIG. 4 is a side view of an alternate structure for attaching the sanding apparatus to sander 10. Two side brackets 40 are attached to the sander frame 11. A flexible mount 41, 42 is attached to brackets 40. Roller 43 is mounted on mount 42 and is positioned above sanding belt 12 by set screw 44. Work piece 31 is moved under roller 43, flexing mount 42 upward until work piece 31 is sanded to a thickness set by set screws 44.

Figure 5:
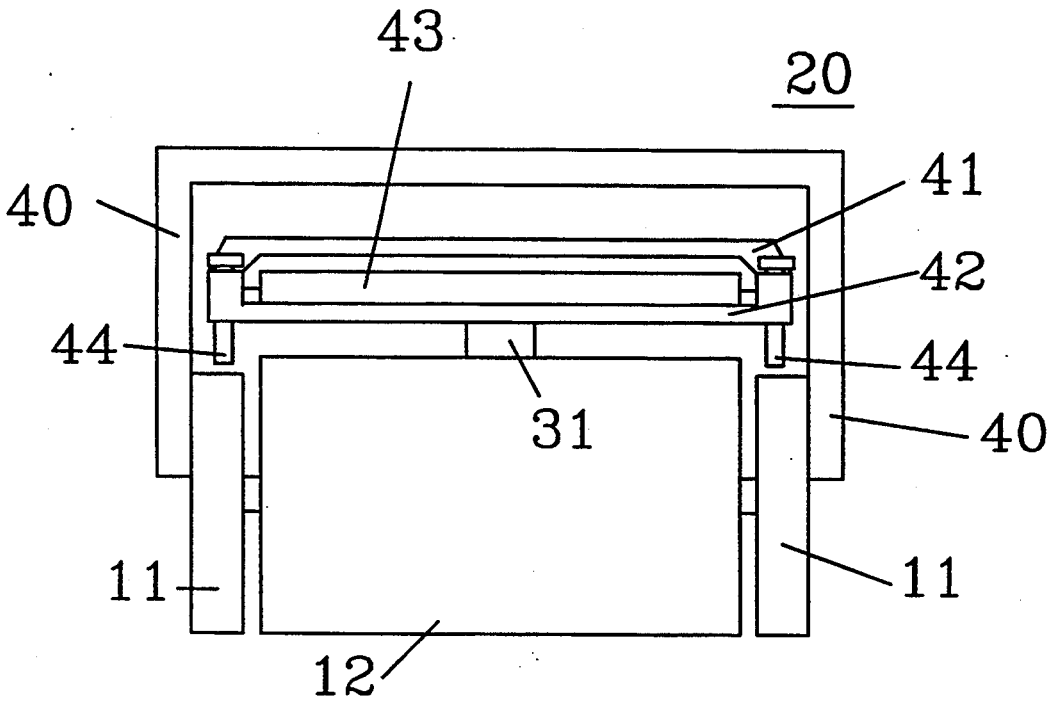
FIG. 5 is an end view of the sander and the jig.

FIG. 5 is an end view of the embodiment of FIG. 4. The two brackets 40 support flexible mount 41,42 holding roller 43 above sanding belt 12. Work piece 31 flexes mount 42 upward. Set screws 44 set the minimum distance roller is above sanding belt 12.

Figure 6:
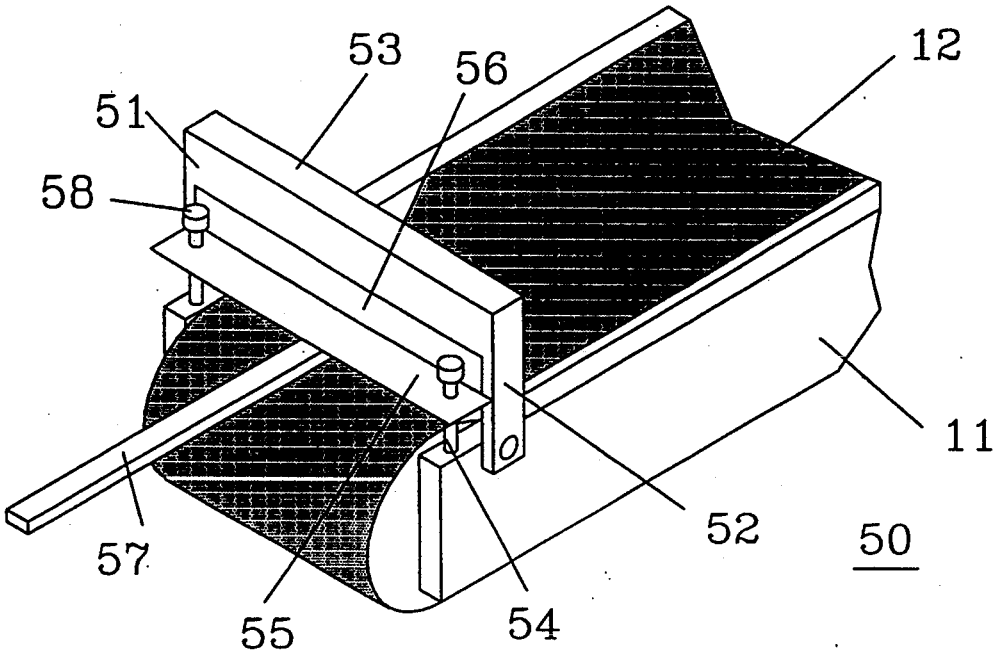
FIG. 6 is a second embodiment of the invention.

FIG. 6 illustrates an alternate work piece guide. No roller is used. Flexible guide 55, 56, which may be of a flexible metal, plastic or composite materials, is mounted on bracket 53 which has side supports 51 and 52 which attach bracket 53 to sander frame 11. Flexible guide can also be mounted similarly to the mounting structure of FIG. 1, where flexible guide 55, 56 is secured to a bracket that mounts over fence 13. In the embodiment of FIG. 6, set screws 53 and 54 holds flexible guide 55 at a preset distance from sanding belt 12. As a work piece 57 is moved under guide 55, guide 55 flexes upward. As work piece 57 is sanded thinner, guide 55 will be lowered until set screws fence the downward movement of guide 55.

Figure 7:
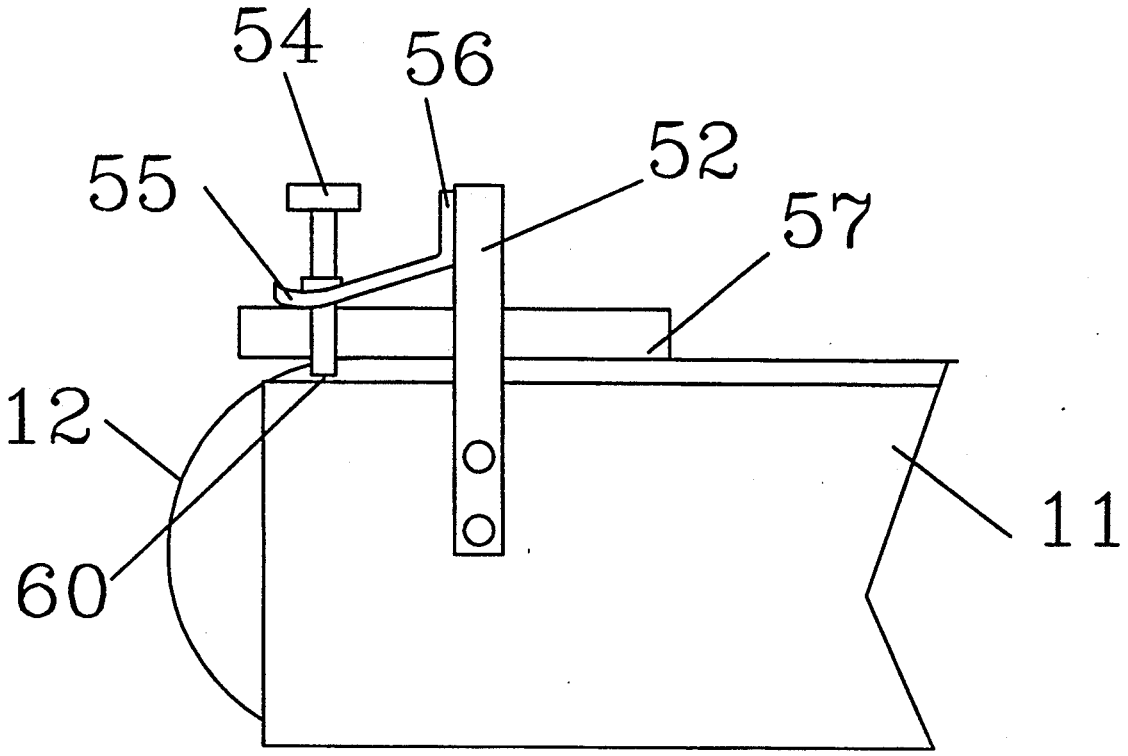
FIG. 7 is a side view of the embodiment of FIG. 6.

FIG. 7 is a side view of the embodiment of FIG. 6. Work piece holds the ends of set screws. 54 and 58 (not shown in FIG. 7) above the sander frame 11, as indicated at 60. As work piece becomes thinner from sanding, set screws 54 and 58 are lowered until the ends stop on sander frame 11. At this time the work piece has been sanded to the preset thickness as determined by the distance from the bottom of guide 55 to sanding belt 12.

Figure 8:
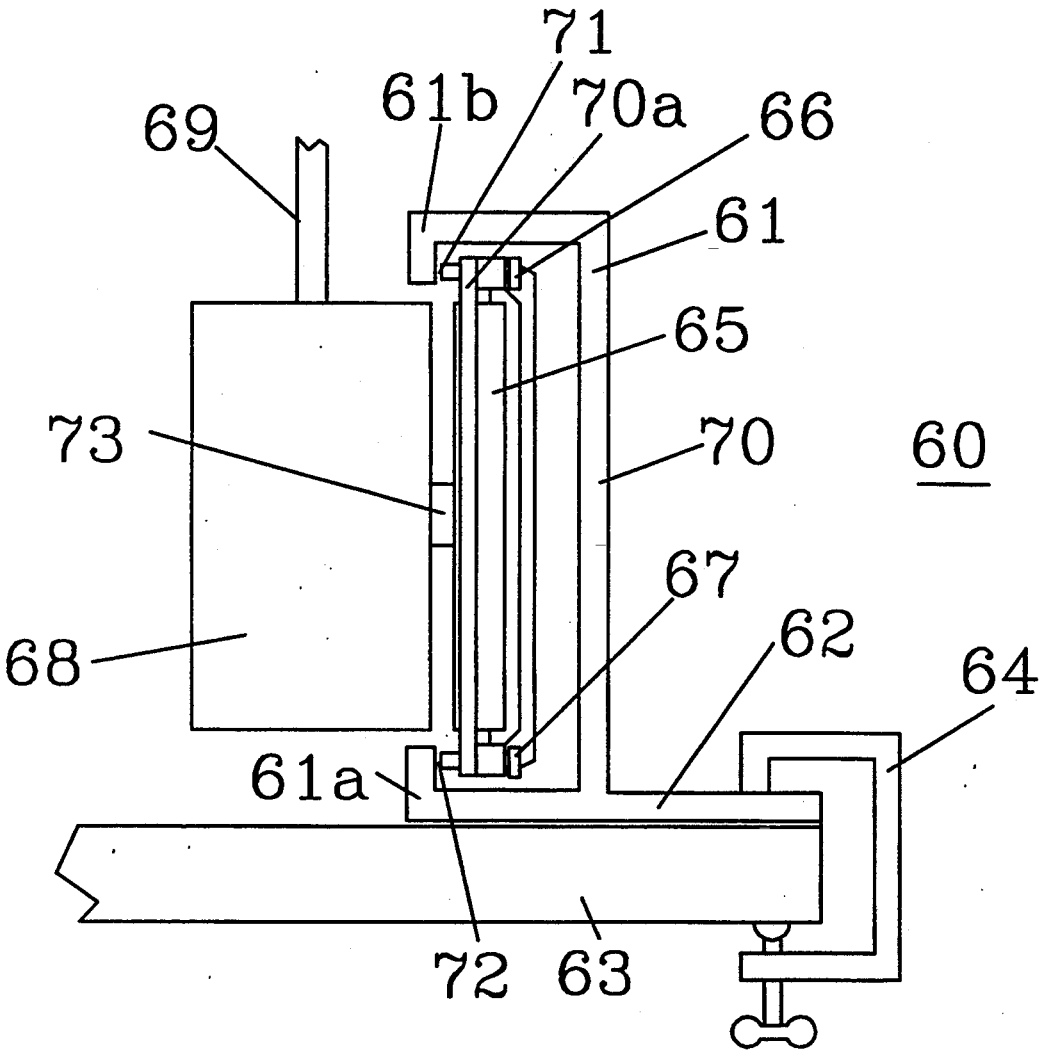
FIG. 8 shows a sanding attachment for use with a drum sander.

FIG. 8 show a sanding attachment 60 for use with, for example, a drum sander 68 attached to a drill press (not illustrated) by shaft 69. Attachment 60 has a frame 61 and an extension arm 62 that is clamped or otherwise attached to drill press table 62. Mounted on frame 61 is flexible plate **70, 70*a* on which is mounted roller 65. Part 70*a* of flexible plate 70 is positioned above frame extensions 61*a* and 61*b* by set screws 66 and 67. When work piece 73 is inserted between roller 68 and roller 65, flexible plate 70*a* is flexed to the right (as illustrated in FIG. 8) moving set screws 66 and 67 away from extension 61*a* and 61*b*, as illustrated 71 and 72. As work piece 73 is sanded thinner, set screws 66 and 67 move toward frame extensions 61*a* and 61*b* until set screws 66 and 76 are seated on frame extensions 61*a* and 61*b*. At this time, work piece 73** has been sanded to the desired thickness.

The attachment of the present invention is adaptable for horizontal mounted drum sanders. The attachment illustrated in FIGS. 2 through 6 may be mounted over horizontally mounted drum sanders.

What is claim:

1. An attachment for a sanding device having a rotating sanding surface and a fence extending across the sanding surface, comprising:

a bracket, attachable to said fence above the sanding surface;

a flexible sanding guide attached to said bracket and spaced from said sanding surface; and at least one set screw for presetting a minimum height of said flexible sanding guide above the sanding surface.

2. The attachment according to claim 1, wherein a roller is mounted on said flexible sanding guide.

3. The attachment according to claim 1, wherein said bracket mounts to an existing fence extending across and above the sanding surface.

4. The attachment according to claim 1, wherein said bracket is attached to the sanding device frame.

5. The attachment according to claim 3, where the bracket is secured to said existing fence by screws.

6. The attachment according to claims 3, where the bracket is secured to said existing fence by friction.

7. An attachment for a belt sander having a rotating sanding belt and a fence extending across and above the sanding belt, comprising:

a mounting bracket mounted on said fence above said sanding belt;

a flexible sanding guide attached to the mounting bracket above the sanding belt;

at least one set screw for presetting a minimum height of said sanding guide above the sanding belt.

8. The attachment according to claim 7, wherein said sanding guide includes a roller mounted on a surface of said flexible sanding guide.

9. The attachment according to claim 7, wherein said flexible sanding guide is a flexible material attached to said bracket.

10. The attachment according to claim 7, wherein said bracket mounts to said fence extending across and above the sanding belt.

11. The attachment according to claim 7, wherein said bracket is attached to the belt sander frame.

12. The attachment according to claim 10, where the bracket is secured to said existing fence by screws.

13. The attachment according to claim 10, where the bracket is secured to said existing fence by friction.

* * * * *